US007143829B2

(12) United States Patent
Booth

(10) Patent No.: US 7,143,829 B2
(45) Date of Patent: Dec. 5, 2006

(54) DOWNHOLE TOOL

(75) Inventor: Richard Keith Booth, Isle of Man (GB)

(73) Assignee: Hamdeen Incorporated Limited, Isle of Man (GB)

( * ) Notice: Subject to any disclaimer, the term of this patent is extended or adjusted under 35 U.S.C. 154(b) by 131 days.

(21) Appl. No.: 10/781,937

(22) Filed: Feb. 20, 2004

(65) Prior Publication Data

US 2004/0168806 A1 Sep. 2, 2004

(30) Foreign Application Priority Data

Feb. 20, 2003 (GB) ..... 0303862.7

(51) Int. Cl.
*E21B 37/02* (2006.01)

(52) U.S. Cl. ..... 166/311; 166/173; 166/177.3

(58) Field of Classification Search ..... None
See application file for complete search history.

(56) References Cited

U.S. PATENT DOCUMENTS

| | | | | |
|---|---|---|---|---|
| 3,251,919 | A * | 5/1966 | Ell | 264/251 |
| 3,480,984 | A | 12/1969 | Kidd | 15/104.06 |
| 3,619,944 | A | 11/1971 | Collins | 15/104.061 |
| 3,939,519 | A | 2/1976 | Muirhead | 15/104.061 |
| 4,081,875 | A | 4/1978 | Nishino | 15/104.06 |
| 4,122,575 | A | 10/1978 | Sagawa | 15/104.06 |
| 4,603,449 | A | 8/1986 | Knapp | 15/104.061 |
| 5,068,142 | A | 11/1991 | Nose et al. | 442/50 |
| 5,244,505 | A | 9/1993 | Allison et al. | 134/22.11 |
| 5,379,475 | A | 1/1995 | Sivacoe | 15/104.061 |
| 5,419,397 | A | 5/1995 | Reynolds et al. | 166/312 |
| 5,600,863 | A | 2/1997 | Curran | 15/104.061 |
| 5,657,820 | A | 8/1997 | Bailey et al. | 166/55.7 |
| 5,797,993 | A | 8/1998 | Woehleke | 134/8 |
| 5,819,353 | A | 10/1998 | Armell et al. | 15/104.2 |
| 5,964,004 | A | 10/1999 | Bean | 15/104.05 |
| 6,152,221 | A | 11/2000 | Carmichael et al. | 166/174 |
| 6,312,637 | B1 * | 11/2001 | Evans et al. | 264/275 |

FOREIGN PATENT DOCUMENTS

| | | |
|---|---|---|
| DE | 29 44 709 A1 | 5/1981 |
| GB | 2327963 A | 2/1999 |

OTHER PUBLICATIONS

"What is Kevlar," (May 30, 2006), http://www.dupont.com/kevlar/whatiskevlar_main.html, 2 pages.

* cited by examiner

*Primary Examiner*—Zakiya W. Bates
(74) *Attorney, Agent, or Firm*—Fleshner & Kim LLP

(57) ABSTRACT

A downhole tool for conditioning a casing or liner. The tool includes blades having a a circumferential peripheral edge for 360 degree contact with the casing or liner and are formed from a composite material which comprises a polymeric fiber. Such polymeric fibers include Kevlar®, Twaron®, Dyneema®, Spectra® and Diolen®. Bypass channels for fluid flow past the tool are provided in either the tool body or the blades.

21 Claims, 6 Drawing Sheets

DOWNHOLE TOOL

Figure 1A:
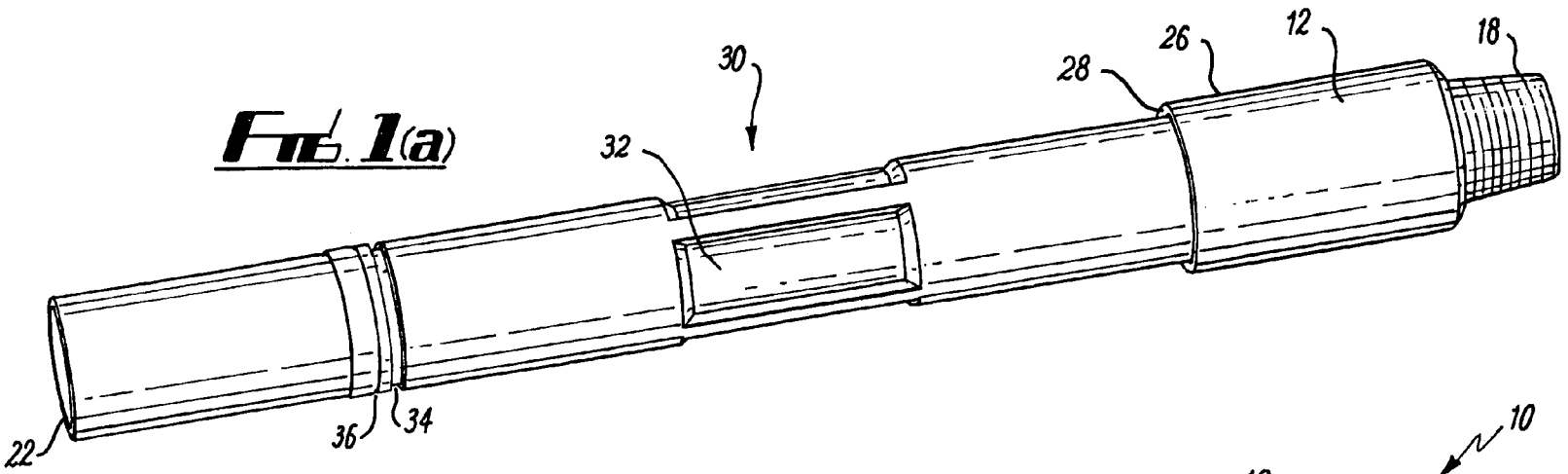

The present invention relates to downhole tools for use in the oil and gas industry and in particular, though not exclusively, to a tool including blades to condition, by grooming, the inside walls of casing or liner used in a well bore.

In a cased or lined well bore it is necessary to remove debris and other particulate matter from the inner wall of the casing or liner before performing certain operations in the well bore such as setting a packer or running a completion. Such conditioning of the well bore is generally provided by brushing or scraping the inner wall of the casing or liner. The aim being to provide a smooth clean surface upon which a seal can reliably be made.

It is known in the art to provide brushes on the outer surface of a cylindrical body mounted in a work string, to 'brush' debris from the inner wall of casing or liner as the string is run or removed from the borehole. Such brushes have limited application downhole as, due to the 'wet' environment in which they must work, they are prone to clogging.

Scrapers have also been arranged on a cylindrical body mounted in a work string. These are generally spiral metal blades which scrape against the inner wall of the casing or liner. They must be perfectly sized to match the casing or liner in use and can damage the surface of the liner or casing if grit becomes trapped between the outer edge of the blade and the inner wall of the casing or liner.

To overcome these disadvantages, scrapers made of rubber materials have been developed which reform within the casing to cover any mismatch in size and provide a 'wiper' to the casing or liner wall. Unfortunately, rubber has a limited life span as it wears quickly in downhole environments.

It is an object of at least one embodiment of the present invention to provide a downhole tool for conditioning a casing or liner wall which obviates or mitigates the disadvantages of the prior art.

It is a yet further object of at least one embodiment of the present invention to provide a downhole tool which can be used when the work string is rotated, run in or pulled out of the well bore.

It is a yet further object of at least one embodiment of the present invention to provide a method of forming a scraper for a downhole tool.

According to a first aspect of the present invention there is provided a downhole tool for conditioning a casing or liner wall, the tool comprising a substantially cylindrical body connectable in a work string, a sleeve located around the body, one or more blades located on the sleeve, wherein each blade has a circular peripheral edge distal to the sleeve and each blade is manufactured from a composite material which comprises a polymeric fibre.

Preferably the polymeric fibre is chosen from the group comprising polyaramid fibres, polyethylene fibres, polypropylene fibres, polyacryl fibres, polyester fibres, polyacryl fibres or poly{2,6-diimidazo[4,5-b4',5'-e]pyridinylene-1,4 (2,5-dihydroxy)phenylene} (PIPD) fibres.

Preferably the polyaramid fibres are produced from polyparaphenylene terephthalamide commonly referred to by its trade name Kevlar® or Twaron®.

Preferably the polyethylene fibres are those commonly referred to as Dyneema® or Spectra®.

Preferably the polyester fibres are those commonly referred to as Diolen® .

Preferably the poly{2,6-diimidazo[4,5-b4',5'-e]pyridinylene-1,4(2,5-dihydroxy)phenylene} (PIPD) fibres are commonly referred to as M5®.

Composites including polymeric fibres provide a blade which both has a degree of flexibility and sufficient abrasion resistance to successfully 'knock-off' debris from the casing or liner wall and cope with small mismatches between the blade diameter and the inner wall diameter. This allows the blades to be sized to the actual casing ID (Inner Diameter).

By providing a complete uninterrupted circular peripheral edge to the blade, maximum strength across the blade is achieved while additionally the blade can provide a cleaning action without the need to rotate the blade within the well bore.

Preferably the composite comprises KEVLAR®. Preferably also the composite further includes carbon. Preferably also the composite includes glass fibre. Thus in the preferred embodiment the blades are made from a KEVLAR® carbon glass composite.

Preferably the sleeve is adapted to rotate independently of the body. Thus the body can rotate with the work string while the sleeve may remain static. This may be referred to as a 'through rotational mandrel'.

Preferably the sleeve includes a plurality of bypass ports to allow fluid to pass between the sleeve and the tool. More preferably there are pairs of bypass ports, each bypass port of each pair being arranged on either side of the one or more blades to prove an entry bypass port and an exit bypass port respectively. This arrangement provides a bypass around the blade(s).

Preferably one or more channels are located on an outer surface of the body. More preferably the channel(s) align with the ports so bypassing fluid can travel through the channel(s). This provides a flow through area to the tool in use.

Alternatively one or more ports may be located through the one or more blades, the ports being distal from the peripheral edge of the blade(s). Thus a fluid bypass is provided through the blades without interfering with the 360 degree grooming action on the wall of the casing/liner.

Preferably the sleeve includes one or more jetting ports. Preferably the jetting ports include nozzles. Advantageously the jetting ports are arranged adjacent the blades so that fluid bypassing the blades jets from jetting ports to provide a cleaning action on the blades.

Preferably the blades are located between flexible members. This allows additional substantially longitudinal movement of the blades and provides spacers for use between the blades. This arrangement provides blades which are not radially biased. The blades may further be mounted on a cartridge which is located on the body. This arrangement allows easy interchange of the blade configuration without the need to handle individual blades. Additionally the cartridge may be radially biased.

Advantageously the blades may be arranged in sets of groups on the sleeve. By providing groups of blades together the blades support each other to give a strength equivalent to use of a thicker blade, while maintaining the flexibility achieved by each narrow blade.

Preferably the blades have an inner circumferential edge such that they form a torus, sometimes referred to as 'do-nut' shaped. Preferably also a diameter of the blade at the inner circumferential edge is greater than an outer diameter of the body at the location of the blade on the body. This mismatch may provide a clearance so that the blade may move radially with respect to the body. The blades may therefore 'retract' towards the tool, away from the low side of the casing/liner, if the tool is used in horizontal or deviated casing. This can protect the blades, so they don't bear the weight of the tool, if a stabiliser or centraliser, preferably sized to drift, is present. Advantageously, the blade may be radially biased by a spring or the like against the body.

Preferably the tool includes one or more additional sleeves. Advantageously these additional sleeves are centralisers as are known in the art to assist in keeping the tool centrally aligned in the casing or liner. Thus he additional sleeves may comprise a plurality of raised portions on an outer surface thereof. Preferably the raise portions are arranged equidistantly around the outer surface of the additional sleeve(s).

Advantageously the sleeve(s) are held to the tool body by one or more holding devices to prevent longitudinal movement of the sleeve(s) on the tool body. Preferably each sleeve abuts another sleeve or a stop on the tool body. An opposite end of a sleeve may then be held in place by the holding device. Preferably the holding device comprises a split ring, a retaining ring and a circlip.

Preferably the holding device is located around the body and abuts the sleeve. The split ring preferably rests against an end of the sleeve and comprises two semicircular members. The split ring bears the load of the sleeve. Preferably the retaining ring comprises a circular member including a circular groove located at a first end thereof. More preferably the split ring locates in the groove such that the split ring is retained by the retaining ring. Preferably the circlip is located at a second end of the retaining ring. The circlip holds the retaining ring in place and bears no load from the sleeve. By taking the load of the sleeve on the split ring, this load is transferred to the body.

Preferably the tool may include an additional operating portion. The additional operating portion may allow the tool to provide an additional function in the casing or liner. Preferably the additional operating portion is a packer as is known in the art, the packer being arranged above the sleeve on the body. The tool is then a packer including a sacrificial scraper mounted ahead of the packer.

Alternatively the additional operating portion may be a cementing unit as is known in the art, the unit being arranged above the sleeve on the body. Thus the tool is a wiper plug wherein the blades provide a barrier between the cement slurry below and the displacing fluid above.

According to a second aspect of the present invention there is provided a holding device for preventing longitudinal movement of a sleeve(s) on a substantially cylindrical tool body, the device comprising a split ring, a retaining ring and a circlip.

The holding device advantageously transfers the load of the sleeve on to the tool body. The holding device may be located around the body and abuts the sleeve.

Preferably the split ring preferably comprises two semicircular members. The split ring may rest against an end of the sleeve and bears the load of the sleeve.

Preferably the retaining ring comprises a circular member including a circular groove located at a first end thereof. More preferably the split ring locates in the groove such that the split ring is retained by the retaining ring.

Preferably the circlip is located at a second end of the retaining ring. The circlip holds the retaining ring in place and bears no load from the sleeve. By taking the load of the sleeve on the split ring, this load is transferred to the body.

According to a third aspect of the present invention there is provided a method of conditioning a casing or liner in a well bore, the method comprising the steps:

(a) locating on a work string, a blade having a circular peripheral edge and made from a composite material which comprises a polymeric fibre;
(b) inserting the work string into the well bore to a position where the peripheral edge makes contact with an inner wall of the casing or liner; and
(c) moving the work string relative to the inner wall to thereby move the blade relative to the wall and provide a grooming action on the wall.

Step (c) may be by rotation of the work string, by running in the well or by pulling out of the well. In a preferred method the blade may move independently of the work string.

Step (b) may include making 360 degree contact between the peripheral edge and the inner wall.

Preferably the method may include the step of providing a fluid bypass to allow fluid to bypass the peripheral edge.

According to a fourth aspect of the present invention there is provided a method of forming a scraper for a downhole tool, the method comprising the steps;

(a) providing a sheet of composite material comprising a polymeric fibre;
(b) instantaneously subjecting the material to first water pressure from a water jet; and
(c) moving the material relative to the jet to cut a profile of a scraper from the material while maintaining the water at substantially the first pressure.

Composite materials typically have laminated structures. Preferably the material is a glass fibre/carbon/polymeric fibre structure. The polymeric fibre may be as described for the first aspect.

By applying the pressure instantaneously to the material, as opposed to the traditional method of gradually increasing the pressure, we have found that the water does not spread between the layers a break up the structure.

Preferably an abrasive such as garnet is mixed with the water. Preferably the water pressure is around 50,000 psi for a 10 mm thick sheet, from a Jet of 0.8 mm diameter and a cutting rate of 1 m/min.

Figure 1B:
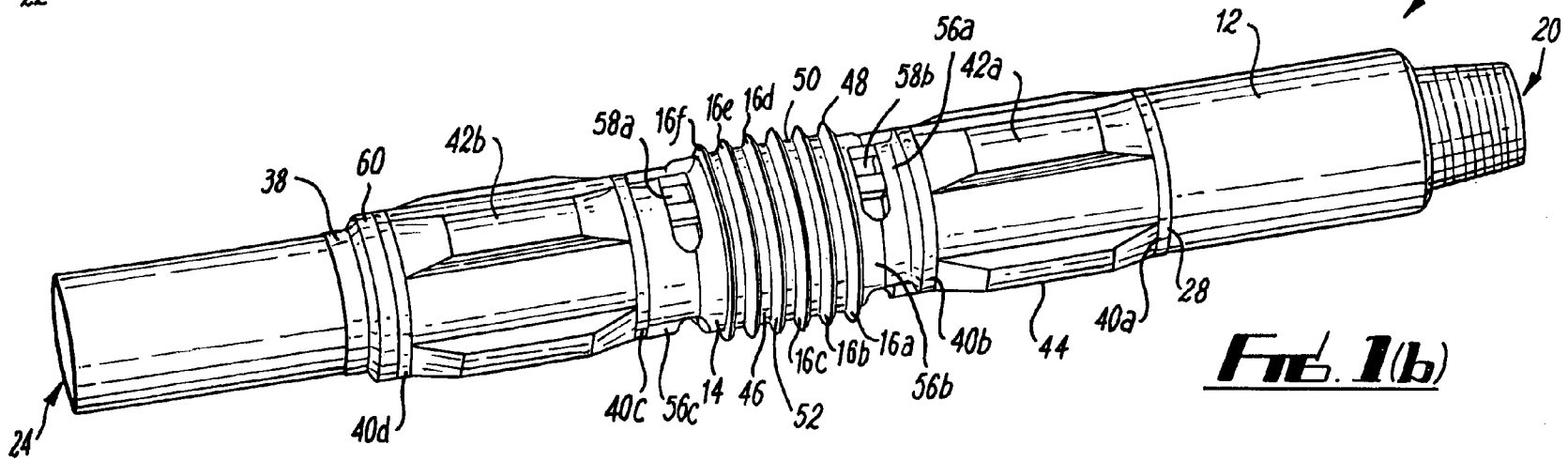
Figure 2A:
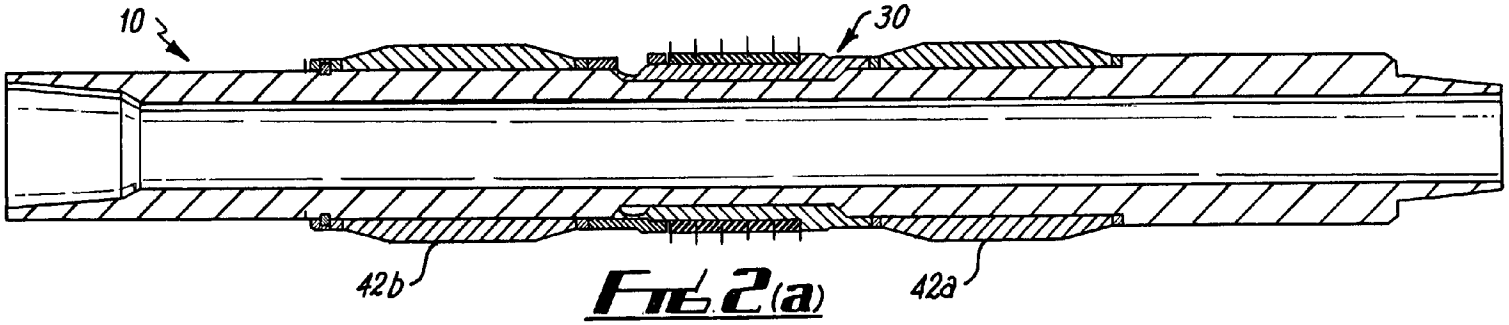
Figure 2B:
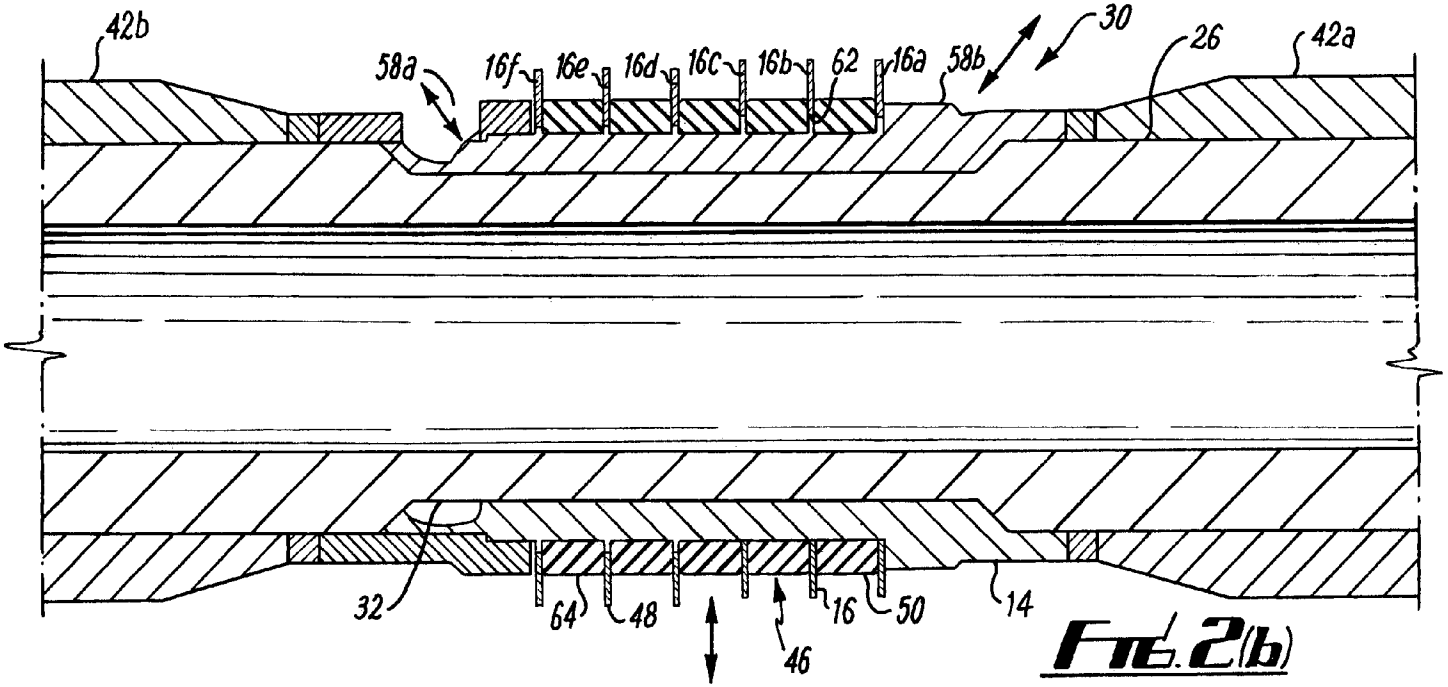
Figure 3A:
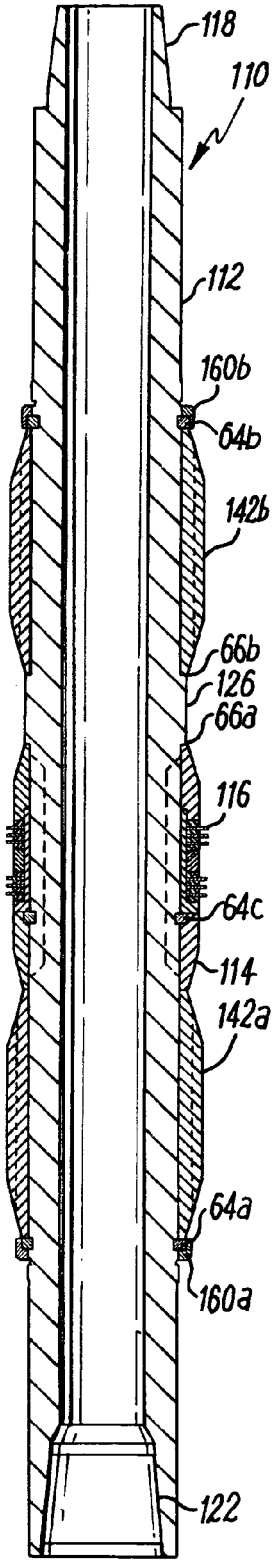
Figure 3B:
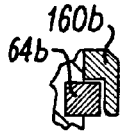
Figure 3C:
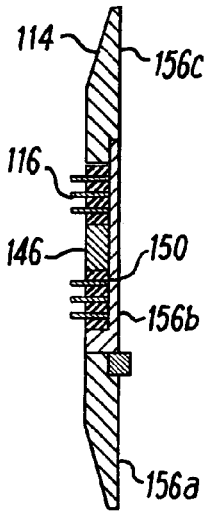
Figure 3G:
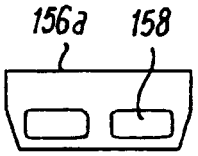
Figure 3D:
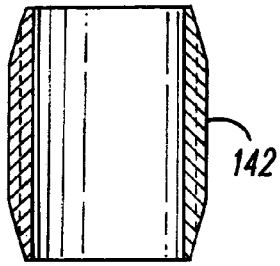
Figure 3E:
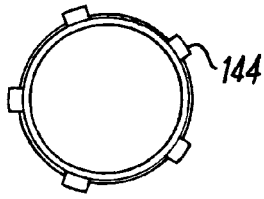
Figure 3F:
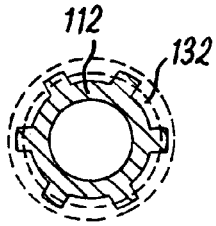
Figure 3H:
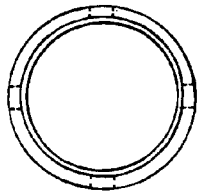
Figure 4:
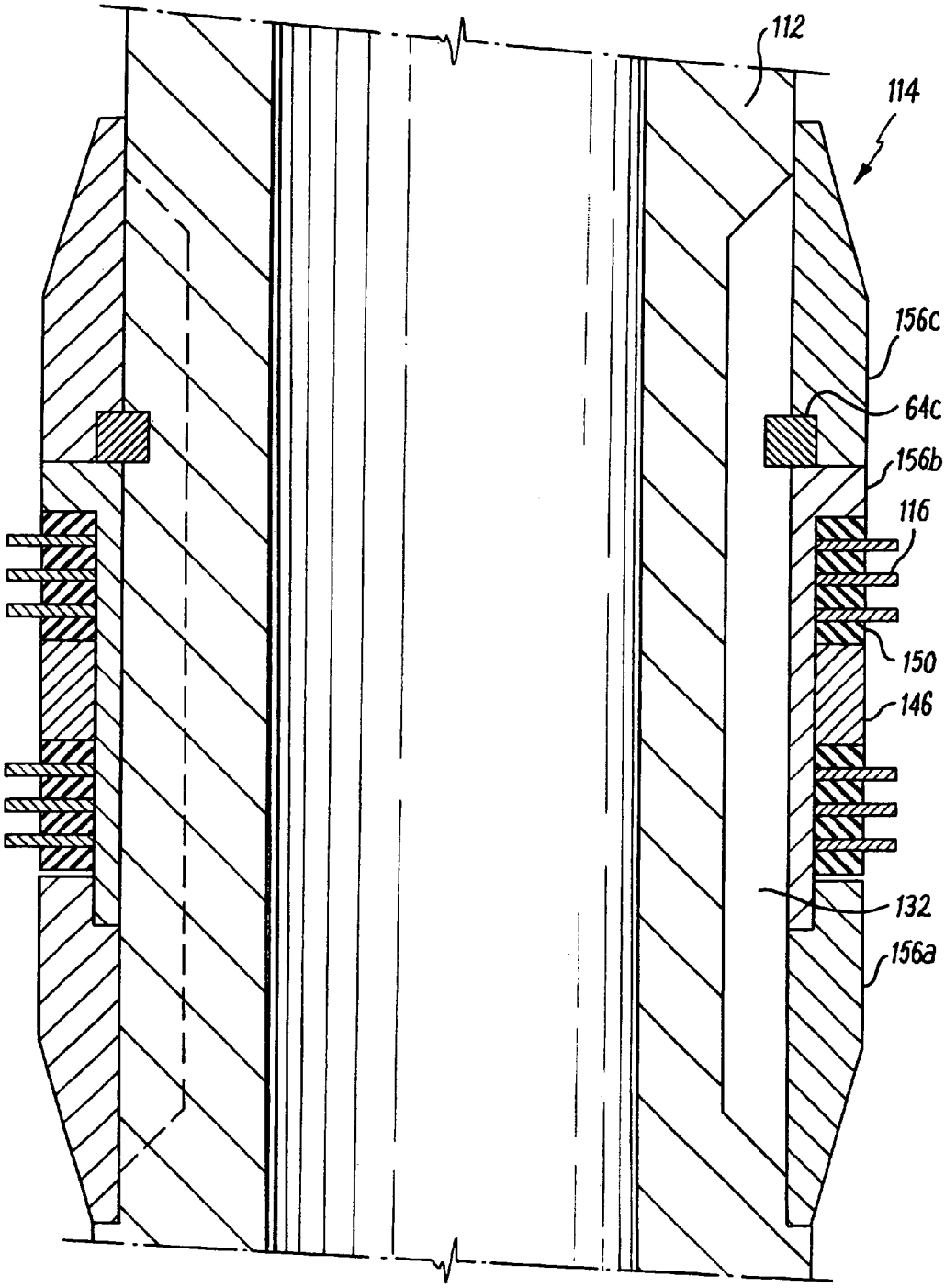
Figure 5A:
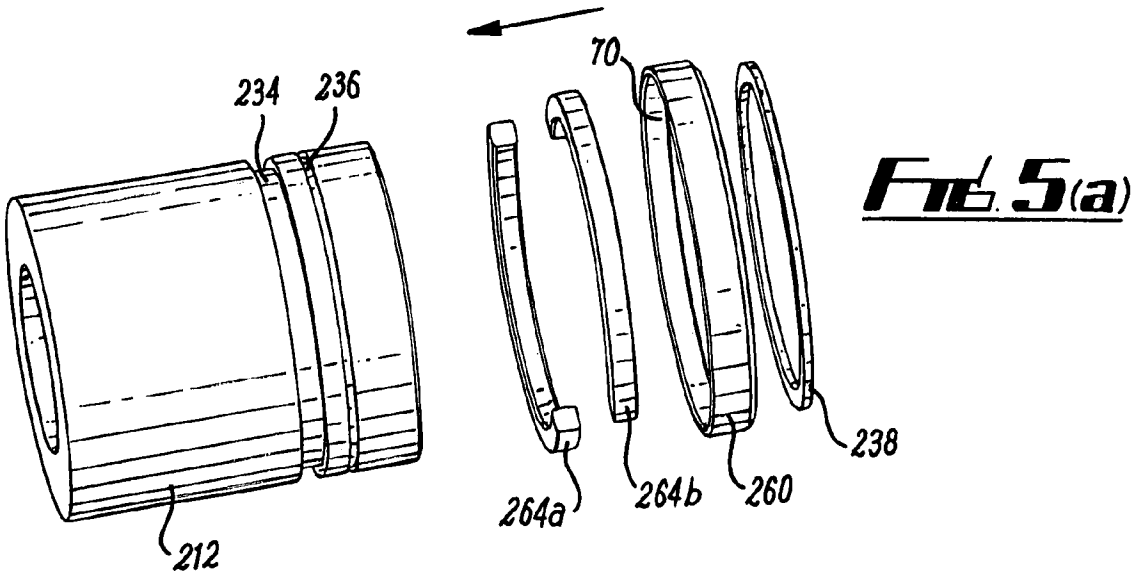
Figure 5B:
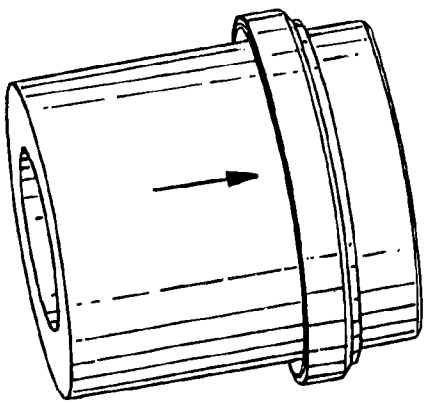
Figure 6:
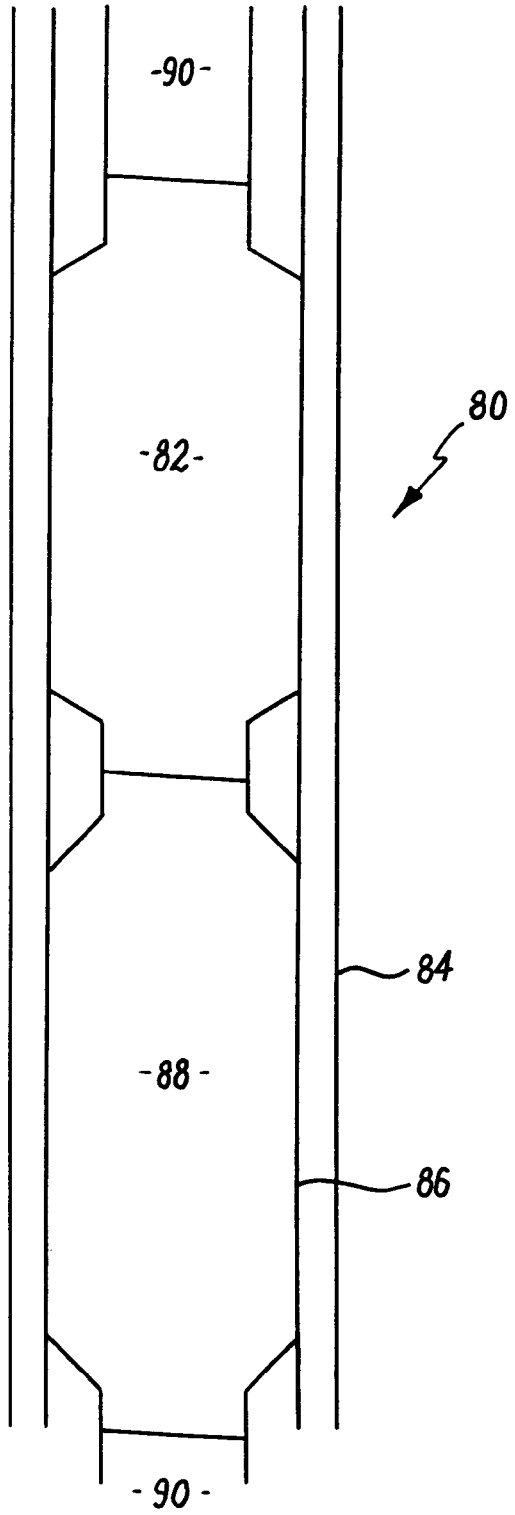

Embodiments of the present invention will now be described, by way of example only, with reference to the following drawings of which:

FIGS. 1(*a*) and (*b*) are illustrative views of a body (a) and tool(b) of a downhole tool according to an embodiment of the present invention;

FIGS. 2(*a*) and (*b*) are cross-sectional views through the tool of FIG. 1;

FIGS. 3(*a*)–(*h*) are cross-sectional views through a downhole tool according to a further embodiment of the present invention;

FIG. 4 is a cross-sectional view through a portion of the tool of FIG. 3;

FIGS. 5(*a*) and (*b*) are schematic diagrams of a holding device according to an embodiment of the present invention; and FIG. 6 is a schematic view of a tool, according to an embodiment of the present invention, operating in a well bore.

Reference is initially made to FIG. 1(*b*) of the drawings which illustrates a downhole tool, generally indicated by reference numeral 10, according to an embodiment of the present invention. Tool 10 primarily comprises a substantially cylindrical body 12, best seen in FIG. 1(*a*), and a sleeve 14 on which is located six blades 16*a–f*.

The body 12 is of single piece hollow bore construction and includes a threaded section 18 at a first end 20 of the tool 10 and a box section 22 at a second end 24 of the tool 10.

The threaded section 18 and box section 22 are as typically used to connect the tool to a mandrel in a work string (not shown). The body 12 includes an outer surface 26 on which is located a ledge 28 formed circumferentially around the body 12. Ledge 28 provides a stop on the body 12. At a central location 30 four channels 32, of rectangular shape are arranged longitudinally on the surface 26. Further on the surface 30 are arranged two further circumferencial grooves 34,36 for holding split rings (not shown) and a circlip 38.

In order, on the body 12, are arranged from the ledge 28, a number of components, each separated by bearing rings 40*a–d* so that the components are through rotational.

The first component is a centraliser 42*a* which is a sleeve including longitudinally arranged raised portions 44. Four raised portions 44 are arranged equidistantly around the centraliser 42*a* to evenly space the tool 10 from the wall of a casing or liner in which the tool 10 is inserted.

A middle component is the sleeve 14 on which is located a blade cartridge 46. The blade cartridge 46 holds the six equally spaced blades 16*a–f*. Each blade is a torus of KEVLAR®/carbon/glass fibre composite, with an outer diameter greater than the diameter at the raised portions 44 of the centralisers 42. The material provides a flexibility so that the blades 16*a–f* can fit within close sized casing or liner, while being strong enough to scrape and remove debris as the edge 48, contacts the casing or liner wall.

Though KEVLAR® is the preferred choice of polymeric fibre, it will be appreciated that other fibres such as polyaramid fibres including poly-paraphenylene terephthalamide commonly referred to by its trade name Twaron®; polyethylene fibres including those commonly referred to as Dyneema® or Spectra®, polypropylene fibres, polyacryl fibres, polyester fibres including those commonly referred to as Diolen®; polyacryl fibres; or poly{2,6-diimidazo[4,5-b4', 5'-e]pyridinylene-1,4(2,5-dihydroxy)phenylene} (PIPD) fibres commonly referred to as M5®.

The blades 16 are preferably formed from sheets of the composite material. Due to the layered structure of the material traditional methods of gradually applying water pressure from a jet to cut out the blade tend to cause the structure to split and explode. This is caused by the water penetrating between the layers. In the present invention, a high water pressure is applied instantaneously to the structure. This has been found to prevent splitting in the structure. A typical pressure would be 50,000 psi on up to 10 mm thick structure from a 0.8 mm diameter jet. 80 mesh garnet is added to the water as an abrasive to assist in cutting. In this way a one piece blade can be cut with the preferred circumferential outer edge which is uniform with no interruptions i.e a circle. A further circle can be cut from the middle of the blade through which the body can be inserted.

The blades 16*a–f* are spaced by rubber rings 50 which provide a degree of flexibility to the movement of the blades 16*a–f*. It will be appreciated however that the blades need not be equally spaced nor the rings be of rubber, any material providing a degree of flexibility would be appropriate.

Through the rings 50 are arranged ports which include nozzles 54 to jet fluid from behind the cartridge 46 onto the blades 16*a–f* to provide a cleaning action and remove any debris or particles which have become stuck to the surface of the blades 16*a–f*. Further the sleeve 14 is made in three parts 56*a,b,c*. The parts are screwed together to form circularly arranged ports 58*a,b* through which fluid can pass from the casing or liner to the channels 32 in the body 12. Ports 58*a,b* are large slots to provide an unobstructed flow path through the tool 10 when the blades 16*a–f* are sealingly engaged to the wall of the casing or liner. Thus removal of debris will continue successfully even if debris builds up behind or in front of a blade because it is the circumference of the blade that knocks off the debris which is independent of any debris build up. The arrangement of this bypass will be described hereinafter with reference to FIG. 2.

The third and final component is a second centraliser 42*b*, identical to the first centraliser 42*a*. The centralisers 42*a,b* stabilise the tool 10 within the casing or liner to drift.

All the components are held between the ledge 28 and split rings (not shown). The split rings are held within a retaining ring 60 which in turn is held by the circlip 38. All the components are through rotational so that they can remain static while the body 12 and the mandrel to which it is attached can rotate in the well bore. The split ring/retainer ring 60 and circlip 38 arrangement is described hereinafter with reference to FIG. 5.

Reference is now made to FIG. 2 of the drawings which shows the central portion 30 of the tool 10 of FIG. 1(*b*). Like parts have been given the same reference numeral to maintain clarity. Ports 56 locate over the channels 32 to provide a fluid bypass under the blades 16*a–f*. The fluid bypass is bi-directional and thus can redirect fluid when the tool 10 is run in, pulled out or if fluid is circulated or reverse circulated in the casing or liner.

Also shown in FIG. 2 are the arrangement of the blades 16*a–f* with respect to the body 12 of the tool 10. As described previously, blades 16*a–f* are a torus or 'do-nut' shape having an outer peripheral edge 48 and an inner circumferential edge 62. The diameter at the edge 62 is greater than the diameter at the surface 64 of the cartridge 46. In this way the blades 16*a–f* can float on the sleeve 14 by being able to move perpendicularly to the longitudinal axis of the tool 10. At all times, however, a portion of the blade 16 remains within the ring 50. The blades 16*a–f* float independently of each other. If the tool 10 is used in a deviated or horizontal well bore, there will be a tendency for the tool 10 to rest on the low side of the casing or liner. The blades 16 would therefore have to bear the weight of the tool 10 and the work string. In order to prevent this the blades or the blade cartridge float to remain concentric to the casing or liner and allow the centralisers 42*a,b* to support the weight of the tool 10.

Reference is now made to FIGS. 3 and 4 of the drawings which illustrates a downhole tool, generally indicated by reference numeral 110, according to a further embodiment of the present invention. Like parts to those of the embodiment described in FIGS. 1 and 2, have been given the same reference numeral with the addition of 100. Tool 110 has the same components as tool 10 but they are arranged differently on the body 112.

Body 112 has two ledges 66*a,b* located on the outer surface 126. Against one ledge 66*b* is located a centraliser 142*b* which is held in place by split rings 64 and a retaining ring 160*b*. The split ring 64*b* is of two part construction as is known in the art. The retaining ring 160*b* can either screw on to the body 112 or can in tun be held in place by a circlip (not shown). From the second ledge is arranged the sleeve 114 with a second centraliser 142*a* abutted thereto. The second centraliser 142*a* is held in place by an identical split ring 64*a* and retaining ring 160*a* arrangement as the first centraliser 142*b*.

Sleeve 114*a* is made up of three parts 156*a,b,c*. This is best seen with the aid of FIG. 4. Central section 156*b* also carries the cartridge 146 on which the blades 116 are mounted. In this embodiment the blades 116 are mounted in two sets of three. By tightly stacking the blades 116 against the rubber rings 150, each set provides a strength equal to a single blade having triple the thickness but still has the flexibility afforded to the thinner blades 116. And pieces 156*a,c* include rectangular ports 158 to provide for fluid flow into the channels 132. The portions 156 of the sleeve 114 are further held in place by an additional split ring 64*c* located between the central 156*b* and outer 156*a* parts.

Reference is now made to FIG. 5 of the drawings which illustrates a holding device, generally indicated by reference numeral 68, according to a further embodiment of the present invention. Holding device 68 is as used in the tool 10 and like parts to those in FIGS. 1 and 2 have been given the same reference numeral with the addition of 200. The device comprises a split ring 264, a retaining ring 260 and a circlip 238.

On the tool body 212 are arranged two circumferential grooves 234,236. Facing the sleeve (not shown) is arranged the split ring 264 in the first groove 234. The split ring is made of two semi-circular portions which compress against the body 112 when an inner surface 70 of the retainer ring 260 is pushed against them. The retainer ring 260 is held against the split ring 264 by the circlip 238 which itself locates in the second groove 236. It is the split ring 264 which bears the load of a sleeve abutting the holding device 68. This load is transferred to the body 212 through the split rings 264. Thus no load appears on the circlip 238, it merely keeps the retaining ring 260 in place.

In use, a blade 16,116, is chosen which is equal to or slightly greater than the diameter of the casing or liner which requires to be groomed. The blades 16,116 are arranged on the blade cartridge 46,146 and mounted on the sleeve 14,114. The sleeve 14,114 and the centralisers 42,142 are located on the body 12,112 and held in place by the holding device 68 if used. The body 12,112 is then connected to the mandrel of a work string using the box 22,122 section and threaded 18,118 section at each end 24,20 of the tool 10,110. The work string is run in the well bore until the blades reach the location of the casing or liner to be groomed. The work string is then moved relative to the casing or liner and as the edges 48 contact the wall of the casing or liner, debris and particles will be 'knocked-off'. Additionally through the sealing engagement of the blades 16,116 to the wall, the surface of the wall will be effectively wiped clean. During this process fluid within the casing or liner will pass freely through the tool 10,110 by entering the ports 58*a*,158*a*, passing through the channels 32,132 and exiting through the ports 58*b*,158*b*. It will be appreciated that fluid can flow in the opposite direction through the ports 58,158 also.

Reference is now made to FIG. 6 of the drawings which illustrates a downhole tool, generally indicated by reference numeral 80, including the tool 10,110 of the present invention. Tool 80 has a first operating section 82 which contains the known components for performing a function within casing or liner 84. Those skilled in the art will appreciate that section 82 may be a packer, cementing tool or the like which all require to contact the inner surface 86 of the casing or liner 84. The second operating section 88, mounted ahead of the first operating section 82, on the work string 90, is the tool 10,110 as described previously herein. In use, tool 80 provides a grooming function to condition the surface 86 ahead of operation of the section 82.

The principal advantage of the present invention is that it provides a downhole tool for conditioning, by grooming, the inner wall of a casing or liner which utilizes a composite material which comprises a polymeric fibre. This composite provides a flexibility and strength over the prior art blade materials of metal and rubber.

A further advantage of the present invention is that it provides a downhole tool wherein the individual blades provide 360 degree coverage so that the tool can be used when run in or pulled out of a well bore. Further fluid bypass is provided to maintain fluid circulation in the well bore.

A yet further advantage of the present invention is in the provision of a method for cutting the composite material to form a blade.

It will be appreciated by those skilled in the art that various modifications may be made to the invention here-indescribed without departing from the scope thereof. For example, any number of sleeve including the blades may be mounted on a body. Additionally, the blades could be fixed to the sleeve i.e. not floating, but be non-concentric with the work string, either individually or together. It will also be appreciated that while the blades in the Figures are shown as individual circular discs, a strip of composite arranged in a spiral around the sleeve could also be used, thereby reducing the need for the separate by pass.

The invention claimed is:

1. A downhole tool for conditioning a casing or liner wall, the tool comprising:

a substantially cylindrical body connecteable in a work string;

a sleeve located around the body; and one or more blades located on the sleeve, wherein each blade has a circular peripheral edge distal to the sleeve and each blade is manufactured from a composite material which comprises a polymeric fibre.

2. A downhole tool as claimed in claim 1 wherein the polymeric fibre is chosen from the group comprising polyaramid fibres, polyethylene fibres, polypropylene fibres, polyacryl fibres, polyester fibres, polyacryl fibres or poly{2,6-diimidazo[4,5-b4',5'-e]pyridinylene-1,4(2,5-dihydroxy) phenylene} (PIPD) fibres.

3. A downhole tool as claimed in claim 1 wherein the composite further includes carbon and glass fibre.

4. A downhole tool as claimed in claim 1 wherein the sleeve includes a plurality of bypass ports to allow fluid to pass between the sleeve and the body so as to bypass the blades.

5. A downhole tool as claimed in claim 1 wherein one or more ports are located through the one or more blades, the ports being distal from the peripheral edge of the blade(s).

6. A downhole tool as claimed in claim 1 wherein the sleeve includes one or more jetting ports to provide a cleaning action on the blades.

7. A downhole tool as claimed in claim 1 wherein the blades are located between flexible members.

8. A downhole tool as claimed in claim 1 wherein the blades have an inner circumferential edge such that they form a torus and wherein a diameter of the blade at the inner circumferential edge is greater than an outer diameter of the body at the location of the blade on the body.

9. A downhole tool as claimed in claim 1 wherein the tool includes one or more centralisers to assist in keeping the tool centrally aligned in the casing or liner.

10. A downhole tool as claimed in claim 1 wherein the sleeve(s) are held to the tool body by one or more holding devices to prevent longitudinal movement of the sleeve(s) on the tool body and transfer the load on the sleeve to the body.

11. A downhole tool as claimed in claim 10 wherein each holding device comprises a split ring, a retaining ring and a circlip.

12. A downhole tool as claimed in claim 1, wherein the blades are formed from sheets of composite material.

13. A downhole tool as claimed in claim 1, wherein each blade has a laminated structure.

14. A downhole tool as claimed in claim 1, wherein each blade has a substantially planer disc shape.

15. A downhole tool as claimed in claim 14, wherein a circular hole is formed in the center of each blade such that each blade is torus-shaped.

16. A method of conditioning a casing or liner in a well bore, the method comprising the steps:

(a) locating on a work string, a blade having a circular peripheral edge and made from a composite material which comprises a polymeric fibre;

(b) inserting the work string into the well bore to a position where the peripheral edge makes contact with an inner wall of the casing or liner; and (c) moving the work string relative to the inner wall to thereby move the blade relative to the wall and provide a grooming action on the wall.

17. A method of conditioning a casing or liner in a well bore as claimed in claim 16 wherein the blade makes 360 degree contact between the peripheral edge and the inner wall.

18. A method of conditioning a casing or liner in a well bore as claimed in claim 16 wherein fluid bypasses the peripheral edge of the blade through a bypass channel in the tool.

19. A method of conditioning a casing or liner in a well bore as claimed in claim 16, wherein the blade has a laminated structure.

20. A method of conditioning a casing or liner in a well bore as claimed in claim 16, wherein the blade has a substantially planer disc shape.

21. A method of conditioning a casing or liner in a well bore as claimed in claim 16, wherein a circular hole is formed in the center of the blade such that the blade is torus-shaped.

* * * * *